US010170877B2

(12) United States Patent
Van Sambeek

(10) Patent No.: US 10,170,877 B2
(45) Date of Patent: Jan. 1, 2019

(54) CONNECTING DEVICE, ASSEMBLY THEREOF AND ASSEMBLY METHOD THEREFOR

(71) Applicant: JackSavior IP B.V., Rotterdam (NL)

(72) Inventor: Boudewijn John Van Sambeek, Rotterdam (NL)

(73) Assignee: JACKSAVIOR IP B.V. (NL)

( * ) Notice: Subject to any disclaimer, the term of this patent is extended or adjusted under 35 U.S.C. 154(b) by 99 days.

(21) Appl. No.: 14/763,752

(22) PCT Filed: Feb. 13, 2014

(86) PCT No.: PCT/NL2014/050090
§ 371 (c)(1),
(2) Date: Jul. 27, 2015

(87) PCT Pub. No.: WO2014/126467
PCT Pub. Date: Aug. 21, 2014

(65) Prior Publication Data

US 2015/0364881 A1 Dec. 17, 2015

(30) Foreign Application Priority Data

Feb. 13, 2013 (NL) ..... 2010294

(51) Int. Cl.
*H01R 24/58* (2011.01)
*H01R 43/16* (2006.01)
(Continued)

(52) U.S. Cl.
CPC ..... *H01R 24/58* (2013.01); *H01R 43/16* (2013.01); *H01R 4/5041* (2013.01);
(Continued)

(58) Field of Classification Search
CPC ..... H01R 2107/00
See application file for complete search history.

(56) References Cited

U.S. PATENT DOCUMENTS 5,911,601 A * 6/1999 Weingartner ..... H01R 24/58 439/669
6,945,803 B2 * 9/2005 Potega ..... G01R 31/36 439/668

(Continued)

FOREIGN PATENT DOCUMENTS

JP 49-93384 A 12/1947
WO 2013/006309 A1 1/2013

OTHER PUBLICATIONS

International Search Report and Written Opinion, PCT International Application No. PCT/NL2014/050090, dated May 15, 2014.

*Primary Examiner* — Briggitte R Hammond
(74) *Attorney, Agent, or Firm* — McDonnell, Boehnen Hulbert & Berghoff LLP

(57) ABSTRACT

A connecting device including a substantially elongated inserting member extending in a longitudinal direction and comprising a transverse direction transverse thereto, said inserting member comprising an outer surface with at least two electrically conductive parts with insulating material arranged there between; and wherein the inserting member is configured to mechanically and electrically connect the at least two electrically conductive parts with wire ends of a connection cable within the space enclosed by the outer surface.

The invention is further related to an assembly of a connection cable and a connecting device, as well as a method for connecting a connecting device to a connection cable.

27 Claims, 13 Drawing Sheets

(51) Int. Cl.
*H01R 105/00* (2006.01)
*H01R 4/50* (2006.01)
*H01R 107/00* (2006.01)

(52) U.S. Cl.
CPC ..... *H01R 2105/00* (2013.01); *H01R 2107/00* (2013.01); *Y10T 29/49206* (2015.01)

(56) References Cited

U.S. PATENT DOCUMENTS

| | | | | |
|---|---|---|---|---|
| 7,316,588 | B1 * | 1/2008 | Rogers | H01R 23/26 439/668 |
| 8,831,267 | B2 * | 9/2014 | Annacone | H01R 31/06 381/384 |
| 2002/0182940 | A1 | 12/2002 | Haas, II et al. | |
| 2006/0068645 | A1 | 3/2006 | Ollivier | |
| 2010/0279553 | A1 * | 11/2010 | Izumi | H01R 24/58 439/669 |
| 2013/0210286 | A1 * | 8/2013 | Golko | H01R 24/58 439/668 |

* cited by examiner

CONNECTING DEVICE, ASSEMBLY THEREOF AND ASSEMBLY METHOD THEREFOR

CROSS REFERENCE TO RELATED APPLICATIONS

The present application is a national stage entry of PCT/NL2014/050090, filed 13 Feb. 2014, and claims priority to NL 2010294 filed 13 Feb. 2013. The full disclosures of NL 2010294 and PCT/NL2014/050090 are incorporated herein by reference.

The present invention relates to a connecting device, more specifically an audio jack plug or audio jack.

The invention is further related to an assembly of a connection cable and such a connecting device, as well as a method for connecting such a connecting device to a connection cable.

Electronic devices such as media (audio, video) players, computers and (smart) phones normally comprise audio jacks for providing audio generated by said electronic device to an audio output component (headphones, speakers, etc.) coupled to the device.

Audio connectors comprise several conductive pads operative to contact audio plug contact portions to provide electrical paths through which audio signals, power signals, and data signals can be transferred.

A common audio connector is a TRS connector, also known as phone plug or jack plug. TRS is an acronym derived from the names of the three conducting parts of the plug: Tip, Ring, and Sleeve. The sleeve portion usually functions as the ground, whereas—for stereo signals—the ring is normally used for the right-hand audio channel and the tip is normally used for the left-hand audio channel. TRS plugs are also applied as balanced mono plugs.

A common audio connector with an additional electrical path through which e.g. data signals can be transferred is called a TRRS connector. TRRS is an acronym derived from the names of four conducting parts of this kind of plug: Tip, Ring, Ring and Sleeve. The extra conductive ring provides an additional electrical path compared to TRS connectors.

Dimensionally, the TRRS and TRS audio plug have the same overall length, consistent with standard TRS three-contact audio plugs, which allows it to be plugged in both three-contact and four-contact audio jacks.

Common (audio) connectors comprise a longitudinal inserting member that is receivable in and connectable to a connection jack arranged in the housing of an electronic device. This connection jack is provided with a receiving cylinder part adapted to receive the inserting member of the connection plug.

When the audio connection plug is coupled to an electronic device, the inserting member thereof is received in the housing of the electronic device. The audio connection plug also extends with a plug body thereof outside the housing of the electronic device. This connection plug body houses a number of connectors inside. Said connectors are in electrical connection with respective conductive parts of the inserting member, and the different conductive wires of the audio cable are electrically connected to these connectors inside the plug body.

Malfunction of audio connections is mostly caused by excessive force being applied from the cable to the plug still plugged into the jack. For unplugging a plug from a jack, there is a need to apply a pulling force in the appropriate direction, i.e. in the longitudinal direction thereof. However, in many cases where excessive force is applied on the plug from the cable, the force is not applied in the desired unplugging direction.

Another source of excessive forces results from outside forces applied directly to the plug body, e.g. due to successive relatively small forces against the plug body when situated in a jacket or pants pocket, or a larger bump force against the plug body.

Both types of excessive forces might result in malfunction of the cable-plug connection, but could also result in malfunction of the jack connection in the electronic device. For manufacturers of electronic media devices, malfunction of the connection jack results in warranty costs.

There is a need for an improved connection plug, and in order to allow an improved connection plug to be used in combination with existing electronic devices, it would be advantageous if the improved plug has an inserting member with identical outer dimensions as the connection plugs, e.g. audio jack plugs, that are currently on the market.

An object of the present invention is to provide a connection plug, that is improved relative to the prior art and wherein at least one of the above stated problems is obviated.

Said object is achieved with the connecting device, more specifically an audio jack plug, according to the invention, said connecting device comprising:

a substantially elongated inserting member that is extending in a longitudinal direction and that is insertable into a connection jack of an electronic device, said inserting member further comprising a transverse direction extending transverse thereto, said inserting member further comprising an outer surface with at least two electrically conductive parts with insulating material arranged there between; and wherein the inserting member is configured to mechanically and electrically connect the at least two electrically conductive parts with at least two wire ends of a connection cable within the space enclosed by the outer surface.

The conductive wires of the cable are connected both mechanically and electrically by means of compression to the connection plug inside the space enclosed by the outer surface of the inserting member, wherein "mechanically" indicates that the physical connection is also arranged inside said space enclosed by the outer surface of the inserting member.

Because all connections can be arranged inside the inserting member that—in use—is inserted into an electronic (audio) device, an external bulky plug body as known from prior art audio jacks is absent. In prior art audio jacks, the connections between the audio cable and the inserting member are arranged in this bulky plug body.

The absence of a bulky plug body greatly reduces the risk that outside forces are applied directly to a rigid part of the connecting device that in use is arranged outside an electronic (audio) device. Such external forces might be caused by a bump force against this rigid part. Hence, the connecting device according to the present invention reduces the risks that a bump against connecting device leads to malfunction of the connection jack in the electronic device.

Because all components of the connection plug are connected by means of compression, there is no need for conventional connection techniques as soldering or welding. The connection plug is easy to assemble in a healthy environment, and is therefore environmentally friendly.

The different components fit together by means of interference fit or compression. An 'interference fit' between parts refers to the first part slightly interfering with the spatial location of the other part, and commonly includes arrangements referred to as press fit.

According to a preferred embodiment, the connecting device comprises an abutment member arranged in line with the inserting member and that does extend in the transverse direction outward of the outer surface of the inserting member, and wherein an extending surface that is directed towards the inserting member forms an abutment surface.

According to a further preferred embodiment the abutment member comprises a guide slot for guiding a connection cable to the space enclosed by the outer surface of the inserting member.

According to an even further preferred embodiment the electrically conductive wires of the connection cable, in a state wherein the connecting device is connected to the connection cable, diverge away from each other within the space enclosed by the outer surface. Because the separate wires of the connection cable diverge away inside the inserting member that—in use—is inserted into an electronic (audio) device, a bulky plug body as known from prior art audio jacks can be absent.

According to a further preferred embodiment the electrically conductive wires are electrically and mechanically connectable to the at least two electrically conductive parts by means of a compression connection such as an interference or press fit within the space enclosed by the outer surface of the inserting member. Because all components of the connection plug are connected by means of compression, there is no need for conventional connection techniques as soldering or welding. The connection plug is easy to assemble in a healthy environment, and is also environmentally friendly.

According to a further preferred embodiment the inserting member comprises:

- an electrically conductive tip member comprising a tip and a shaft, wherein the tip member forms a first electrically conductive part of the inserting member;
- a first conducting member that forms a second electrically conductive part of the inserting member; and
- a tip member insulator that is arranged between the tip member and the first conducting member and electrically isolates the tip member and first conducting member from each other.

According to a further preferred embodiment the tip member insulator comprises:

- a first through bore that allows the tip member insulator to be substantially close-fittingly arrangeable around the shaft of the tip member; and
- a surface or an inner slot that is arranged in the wall of the through bore and that is configured for receiving a wire end of a first electrically conductive wire of the connection cable, and that is further configured for electrically and mechanically connecting the shaft and the wire end by means of compression.

According to a further preferred embodiment, the connecting device further comprises a second through bore configured for passing there through at least the electrically conductive wire of which the wire end is reversed and arranged on the surface or in said inner slot. The second through bore of the tip member insulator allows the wires to pass with intact insulation around the electrically conductive wires.

The projection in the inner slot is preferably wedge shaped, so that the compression force is gradually and securely applied.

According to a further preferred embodiment the first conducting member is substantially close-fittingly arrangeable around the part of the outer wall of the tip member insulator, wherein the first conducting member forms a second electrically conductive part of the outer surface of the inserting member.

According to a further preferred embodiment the connecting device comprises one or more further insulation members are close-fittingly arranged, said insulation members comprising:

- a through bore that allows the insulation member to be substantially close-fittingly arranged around the shaft of the tip member;
- one or more inner slots for guiding there through one or more electrically conductive wires; and
- an outer wall that is configured for receiving a wire end of an electrically conductive wire of a connection cable, said outer wall being configured to allow the wire end of the electrically conductive wire to be pressed against the conducting member in order to form an electrical and mechanical connection between the wire end and the conducting member.

The principle according to the invention allows for a large number of connections, i.e. even more than the four contacts of a TRRS configuration. However, with a TRRS connection, left-hand and right-hand audio channels, as well as an additional electrical path through which e.g. data signals can be transferred, are available. This is sufficient for most applications. It is however conceivable that the present invention is applied with more than four contacts.

According to a further preferred embodiment the connecting device comprises a circumferential groove that is provided for receiving scraped off insulation material. During the assembly process, the wires may comprise insulation material, i.e. there is no need to remove the insulation beforehand. When the different portions are press fit together, the wire ends are automatically stripped, and the insulation material is pushed forward and into the circumferential groove.

According to a further preferred embodiment the abutment portion is a closing member through which the connection cable is guidable in a non-sliding way. For example, the connection cable can be attached to the closing member using glue, or alternatively be attached by means of guiding the connection cable through a labyrinth arranged within the closing member.

According to a further preferred embodiment the outer surfaces of the tip member insulator, the one or more conducting members and the one or more insulation members together form a substantially flush outer surface of the inserting member. This substantially flush outer surface allows for easy insertion of the inserting member into a connection jack of an electronic device.

According to a further preferred embodiment the tip member insulator, the one or more conducting members and the one or more insulation members are ring shaped and together form a substantially flush rotation symmetric outer surface of the inserting member. A rotation symmetric shape allows for orientation independent insertion of the inserting member into a connection jack.

It is however conceivable that the inserting member is assembled using members of a non-round cross section, e.g. polygonal cross section, which could allow for even more electrically conductive parts. If the (polygonal) cross section is furthermore rotation asymmetric, the inserting member can only be inserted in a specific orientation, which can be beneficial if a large number of connections is to be arranged within a limited space.

According to a further preferred embodiment the connecting device is an audio jack plug, and wherein the outer dimensions of the outer surface of the inserting member are substantially identical to the outer dimensions of a conventional audio jack plug, e.g. according to the national Chinese standard YDT 1885-2009 and/or the RC-5325A standard of the Japanese Electronics and Information Technology industries Association (JEITA).

The invention is further directed to an assembly of a connection cable and a connecting device as described above, wherein the electrically conductive wires of the connection cable branch out within the space enclosed by the outer surface of the inserting member, and are each electrically and mechanically connected to an electrically conductive member of the inserting member of the connecting device in this enclosed space.

The invention is further directed to a method of connecting a connecting device according to a first embodiment as described above to a connection cable, said method comprising the steps of:

arranging a closing member, at least one conducting member and a tip member insulator on the connection cable;

placing wire end of a first wire in contact with a tip member, wherein the tip member comprises a tip and a shaft;

sliding the tip member insulator over the shaft towards and against the tip of the tip member, wherein the wire end is arranged in an inner slot and is electrically and mechanically connected in said slot to the tip member by means of compression;

arranging a wire end of a second electrically conducting wire in an outer slot that is arranged in an outer wall of the tip member insulator;

sliding a first conducting member over the outer wall of the tip member insulator, wherein the wire end is electrically and mechanically connected to the first conducting member by means of compression; and connecting a closing member with a conducting member, wherein said closing member functions as an abutment member and wherein the connection cable is guided through the closing member in a non-sliding way and wherein the connection cable is attached to the closing member.

According to a preferred embodiment one or more further sets of an insulation member and accompanying conducting member are arranged between the closing member and the tip member in order to electrically and mechanically connect further wire ends to an accompanying conducting member by means of compression.

According to a further preferred embodiment the one or more further sets of insulation members and accompanying conducting members are threaded on the connection cable before the tip member insulator is threaded on the connection cable.

The invention is further directed to a method of connecting a connecting device according to a second embodiment as described above to a connection cable, said method comprising the steps of:

arranging a closing member with an abutment member on a connection cable;

guiding wires of connection cable through one or more through bores of the closing member;

bending a wire end of at least one of the wires so that it is bend away from the longitudinal direction of the wires through the one or more through bores; and arranging a conducting member over the closing member until it abuts the abutment member and wherein the bend wire end is pressed so that it bends further in a reverse bend, wherein the wire end comes in an electrical and mechanical connection by means of compression with said further conducting member;

arranging an insulation member in the conducting member and guiding the one or more wires through one or more through bores thereof;

bending a wire end of at least one of the wires so that it is bend away from the longitudinal direction of the wires through the one or more through bores; and arranging a further conducting member against the previous insulation member, wherein the bend wire end is pressed so that it bends further in a reverse bend, wherein the wire end comes in an electrical and mechanical connection by means of compression with said further conducting member.

According to a preferred embodiment, the method further comprises the step of arranging one or more further sets of an insulation member and mating conducting member. In this way a desired configuration of e.g. a TRS or TRRS connector can be assembled.

According to a further preferred embodiment, the method comprises the step of concluding the assembly with a conducting member that is a tip member.

According to an even further preferred embodiment, the connection cable is guided through the closing member in a non-sliding way, and the connection cable is attached to the closing member.

According to a still further preferred embodiment, first the closing member is arranged on the connection cable, followed by the abutment member being arranged on the closing member.

According to a still further preferred embodiment, the abutment member is removed from the closing member after the final conduction member has been arranged.

In the following description preferred embodiments of the present invention are further elucidated with reference to the drawing, in which:

FIG. 17 shows the process step of assembling a further conducting member;

Figure 1:
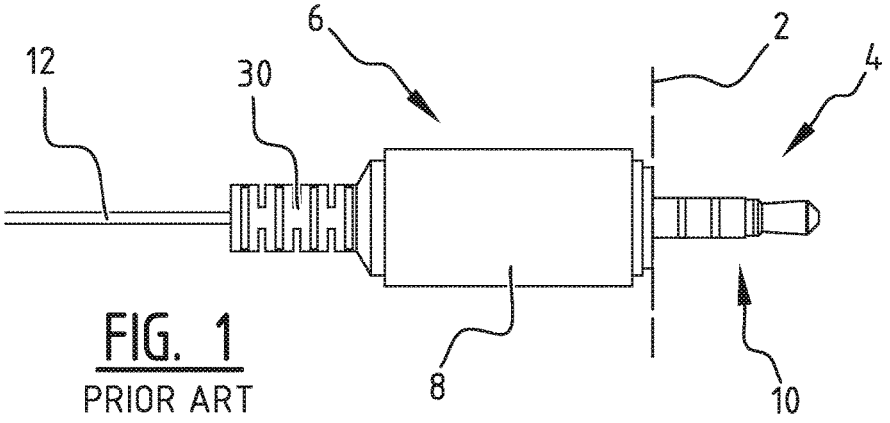
FIG. 1 PRIOR ART
FIGS. 1-3 are different views of a connecting device according to the prior art.
Figure 2:
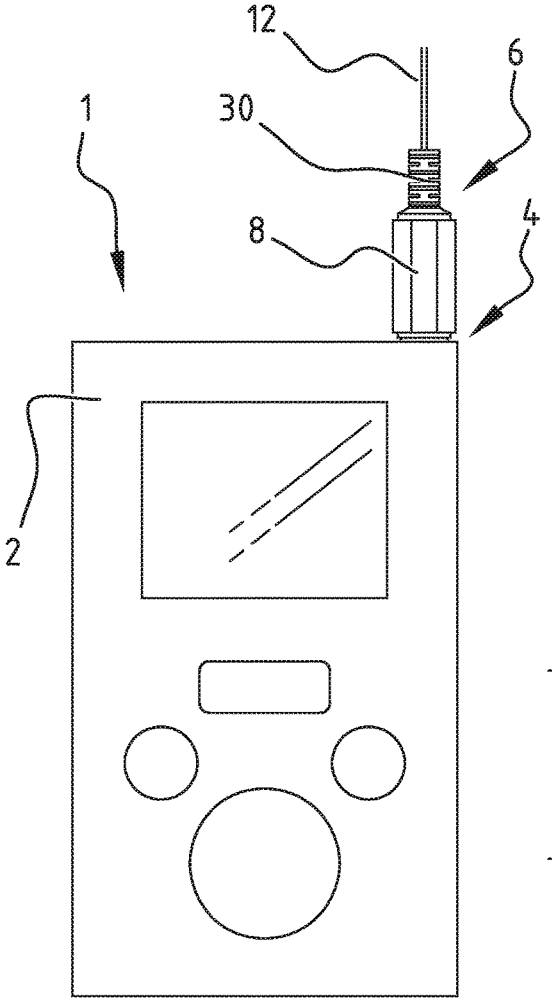
FIG. 2 PRIOR ART
Figure 3:
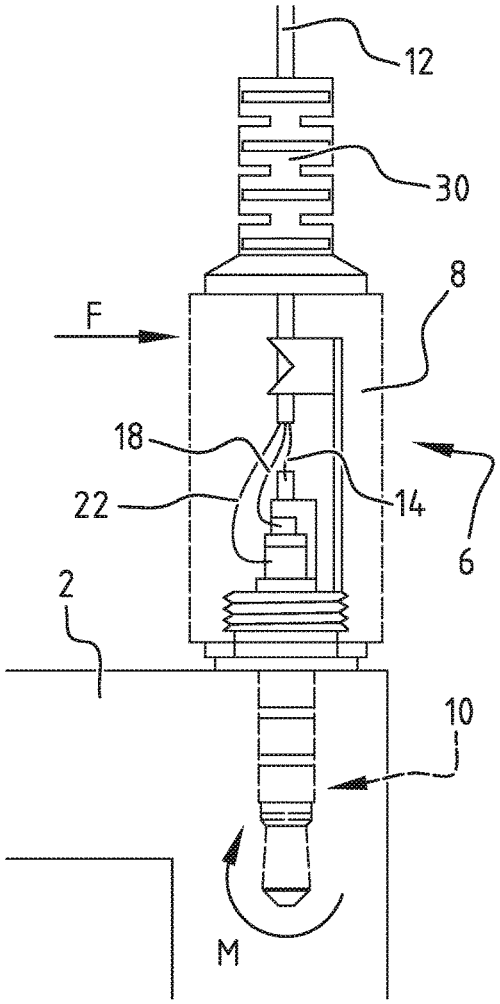
FIG. 3 PRIOR ART
Figure 4:
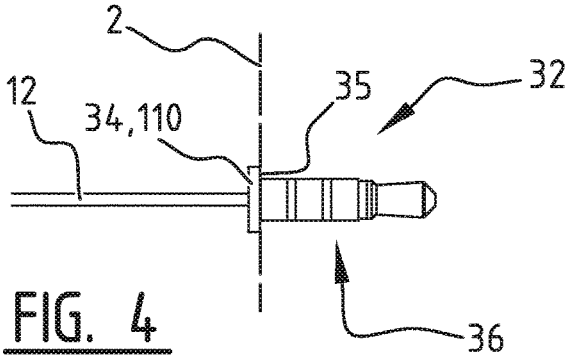
FIGS. 4-6 show a connecting device according to the invention shown in the same views as FIGS. 1-3.
Figure 5:
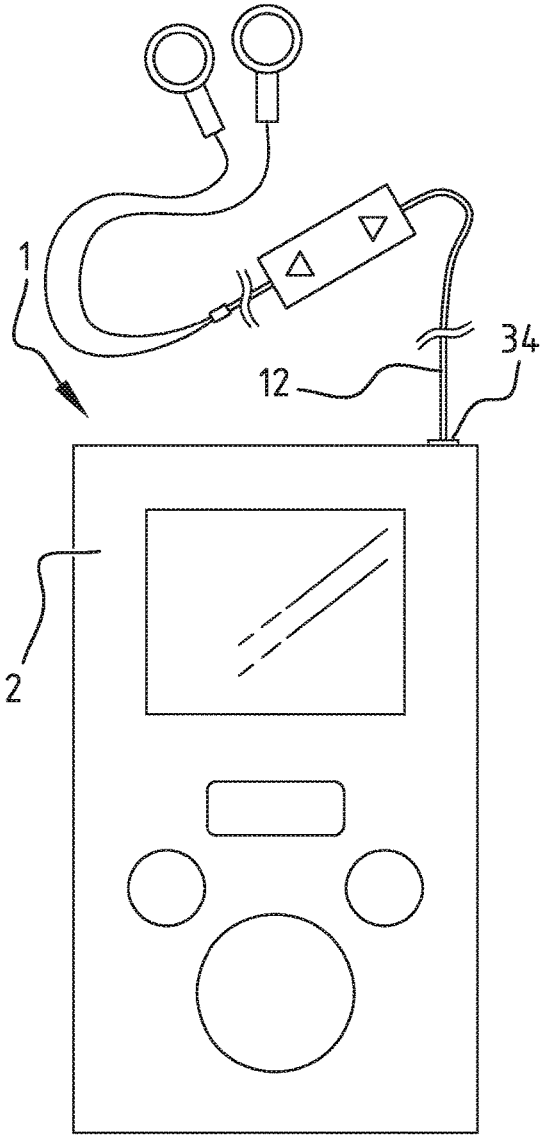
Figure 6:
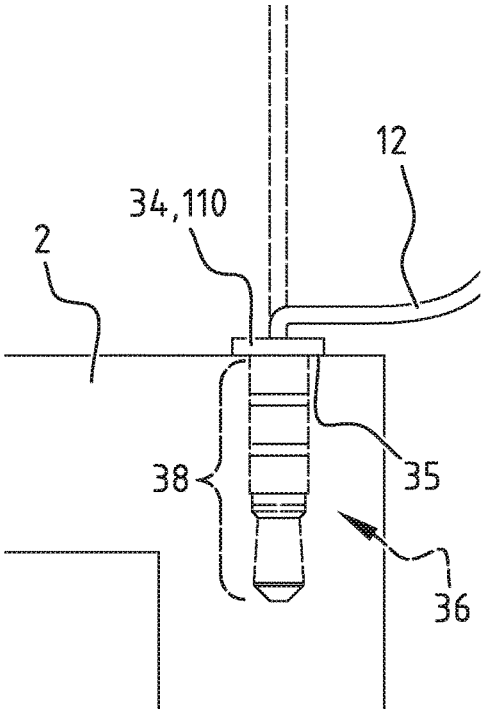

The prior art audio jack plug 6 shown in FIGS. 1-3 comprises a longitudinal inserting member 10 that is insertable into a connection jack 4 of a housing 2 of an electronic (audio) device 1. The connection jack 4 is provided with a receiving cylinder part adapted to receive the longitudinal inserting member 10, 36 of a connecting device.

When this prior art audio jack plug 6 is inserted with its inserting member 10 into the connection jack 4, the plug body 8 is arranged outside the housing 2 of the electronic device 1.

The plug body 8 is a rigid part that houses the connections between the electrically conductive parts of the inserting member 10 and the wires 14, 18, 22 of the audio connection cable 12. The connection between cable 12 and plug body 8 can be guided through a connection member 30 that protects the wires against excessive bending.

When an external force F is applied to the rigid plug body 8, the inserting member 10 will apply a moment force M on the connection jack 4 that is arranged in the housing 2 of the electronic device 1. The moment force M is one of the sources responsible for malfunctions of a connection jack 4 of an electronic device 1.

The connecting device according to a first embodiment of the present invention comprises an inserting member 36 comprising an outer surface 38 with at least two electrically conductive parts 40, 60, 80, 100 with insulating material arranged there between. An abutment member 34 connected to the inserting member 36 forms an abutment surface 35 that abuts against the housing 2 and prevents that the inserting member 36 can be pushed too far into the connection jack 4.

Because the inserting member 10 is configured to mechanically and electrically connect the at least two electrically conductive parts to wire ends of a connection cable 12 within the space enclosed by the outer surface 38, a rigid plug body as the plug body 8 of the prior art audio jacks shown in FIGS. 1-3 is obsolete according to the invention.

The only rigid part extending outward of the housing 2 of an electronic device 1, when the connecting device is inserted into an electronic device 1, is the abutment member 34. Since the abutment member 34 that is formed by the closing member 110 only comprises a very limited height outside the housing 2 of the electronic device 1, the risks of bump forces to this rigid part are very limited. Moreover, the moment arm would be very short due to the limited height, therefore resulting in a significantly lower moment force M applied to the connection jack 4 than would be the case with the audio jack plug 6 according to the prior art.

The process steps of assembling a conducting member according to the present invention is now elucidated in more detail with reference to the FIGS. 7-18.

Figure 7:
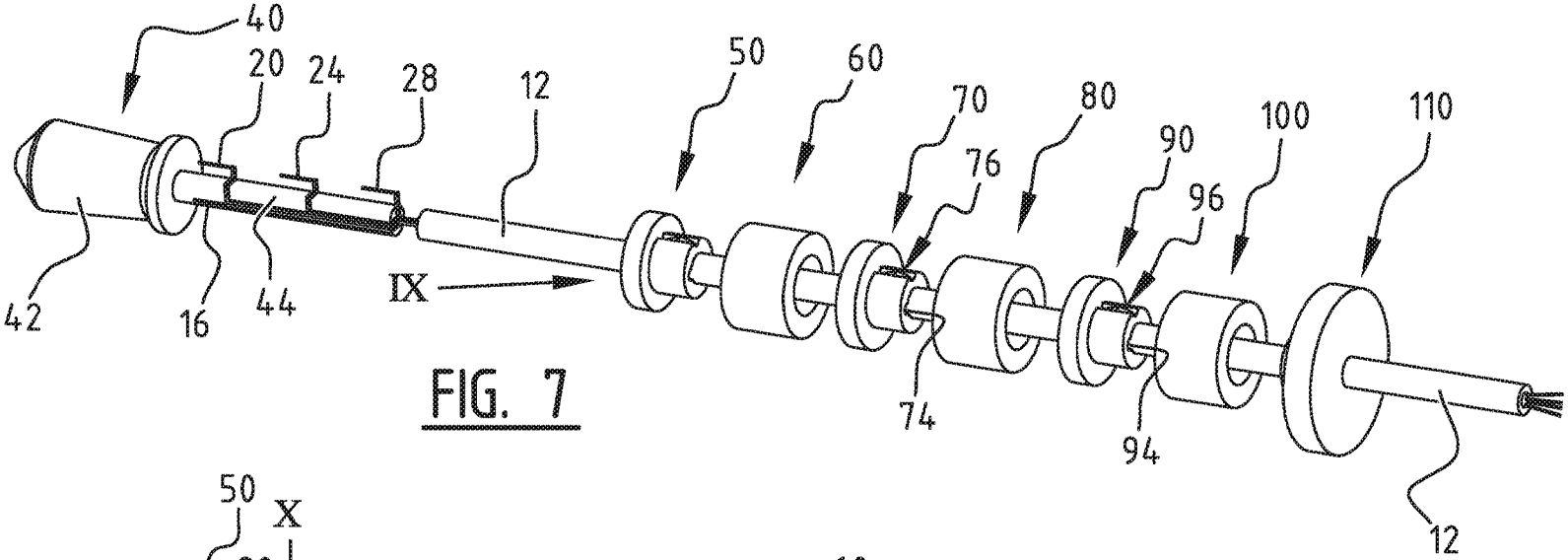
FIGS. 7-10 show the process steps of assembling the tip member insulator of the tip member of the connecting device shown in FIGS. 1-3.

FIG. 7 shows the starting position, wherein the closing member 110, third conducting member 100, a second insulation member 90, a second conducting member 80, a first insulation member 70, a first conducting member 60 and a tip member insulator 50 are threaded over connection cable 12.

The connection cable 12 comprises four wires, the first wire 14 having a first wire end 16, the second wire 18 having a second wire end 20, the third wire 22 having a third wire end 24 and the fourth wire 26 having a fourth wire end 28.

For clarifying reasons, the different wire ends 16, 20, 24 and 28 are shown in their final position relative to the shaft 44 of tip member 40. Tip member 40 further more comprises an electrically conductive tip 42.

In the first process step, the tip member insulator 50 is arranged around the shaft 44 of the tip member 40, after the first wire end 16 of first wire 14 has been arranged in contact with the shaft 44.

Figure 9A:
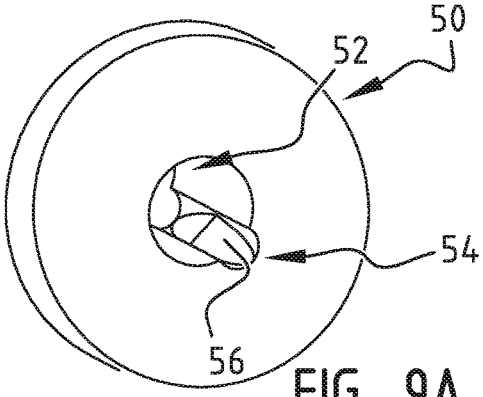
Figure 9B:
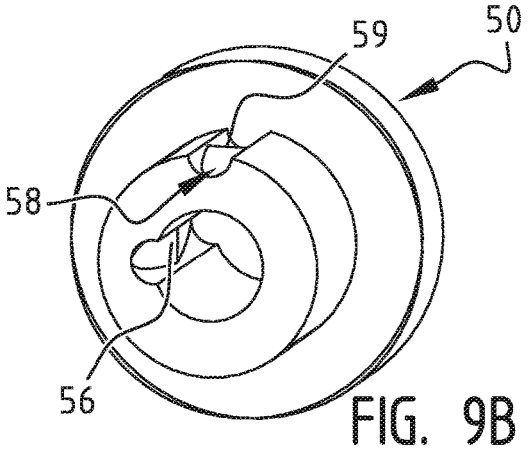

A perspective view of the tip member insulator 50 is shown in FIGS. 9A and 9B. The tip member insulator 50 comprises a through bore 52 with an inner slot 54 that comprises a wedge-shaped projection 56. Although other projections are also applicable, a wedge-shape has the advantage that a compression force is applied gradually while the tip member insulator 50 is slid over the shaft 44. The tip member insulator 50 furthermore comprises an outer slot 58 arranged in an outer wall thereof. This outer slot 58 also comprises a wedge-shaped projection 59.

After the first wire end 16 has been arranged in electrical contact with the shaft 44 of the tip member 40, the tip member insulator 50 is slid over the shaft 44 towards the tip 42 of the tip member 40. The first wire 14 is guided through the inner slot 54. In the final position, wherein the tip member insulator 50 contacts the tip 42 of the tip member 40, the projection 56 electrically and mechanically connects the wire end 16 with the shaft 44 (FIG. 10B).

Figure 8:
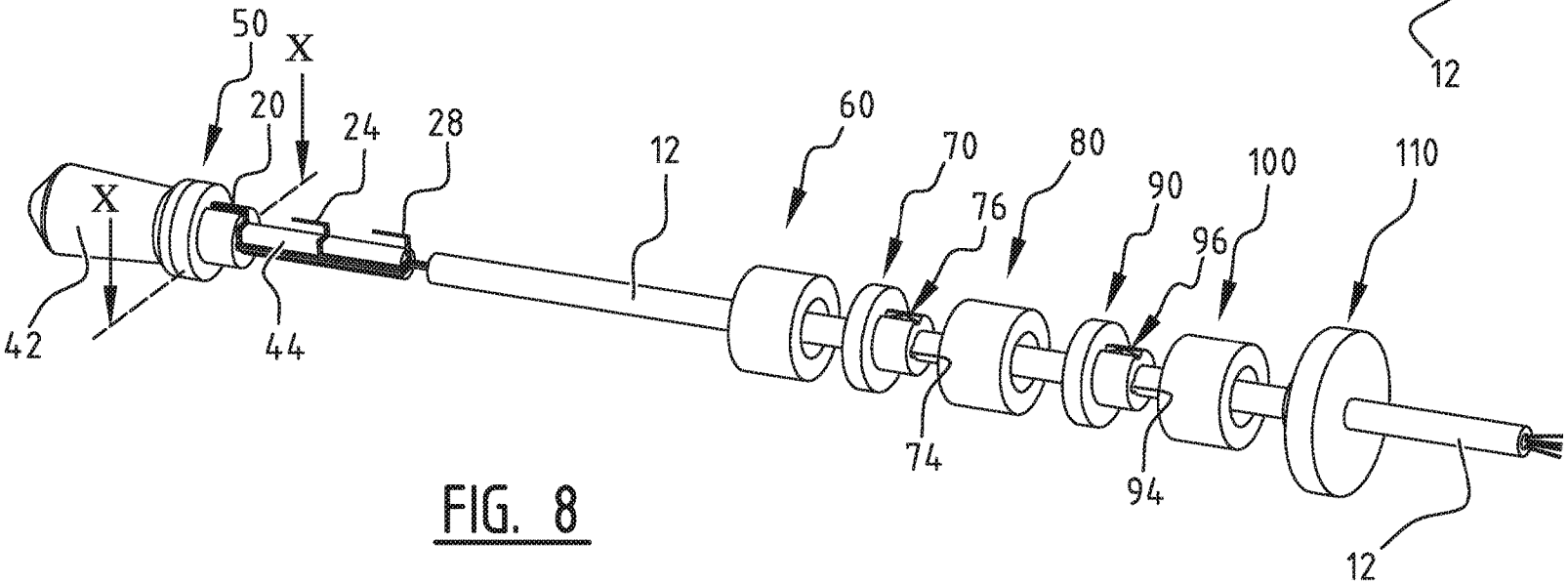
Figure 10A:
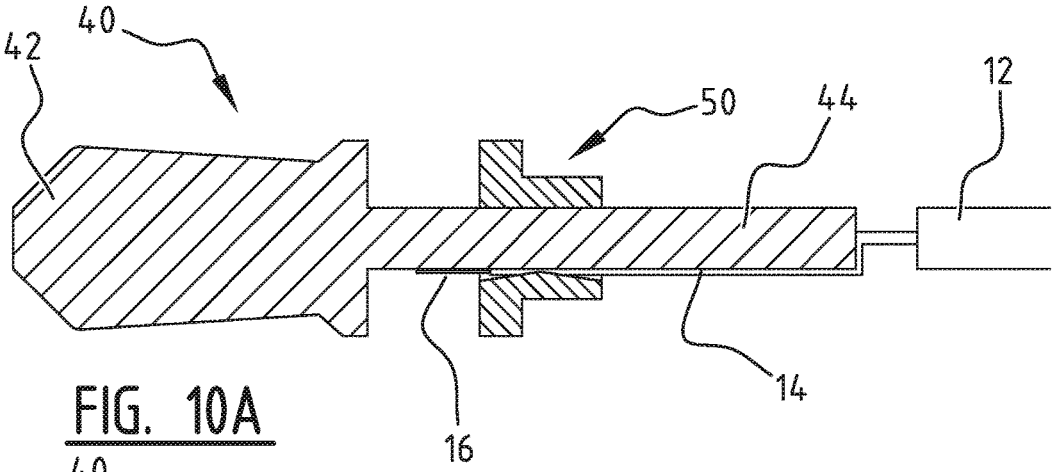
Figure 10B:
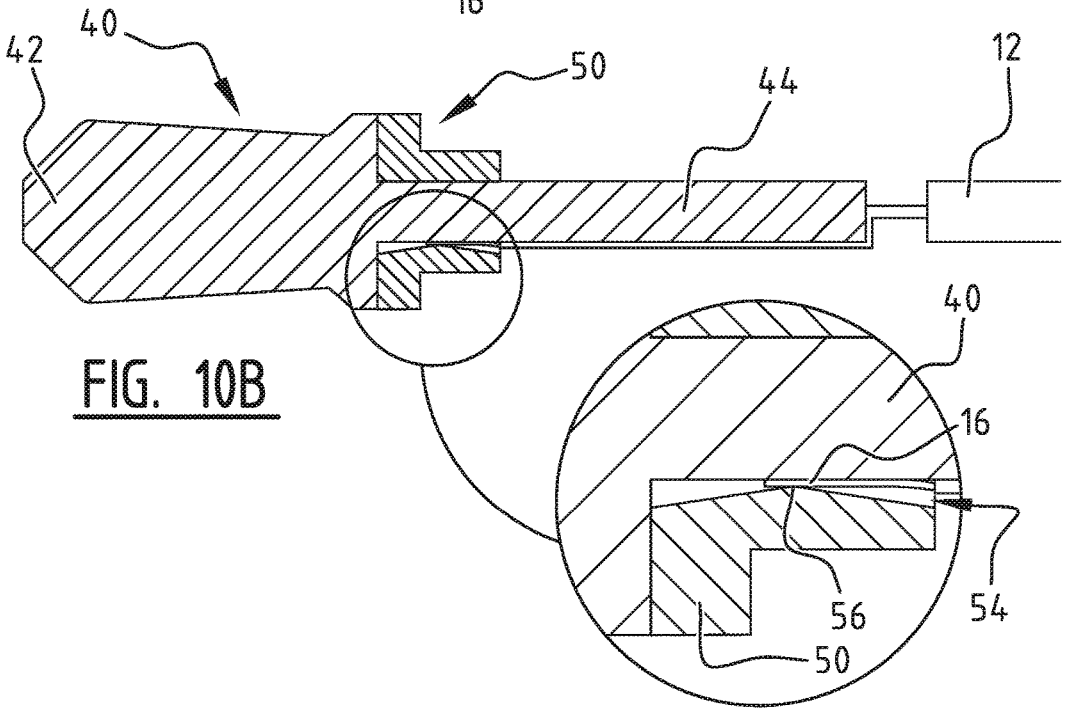
Figure 11:
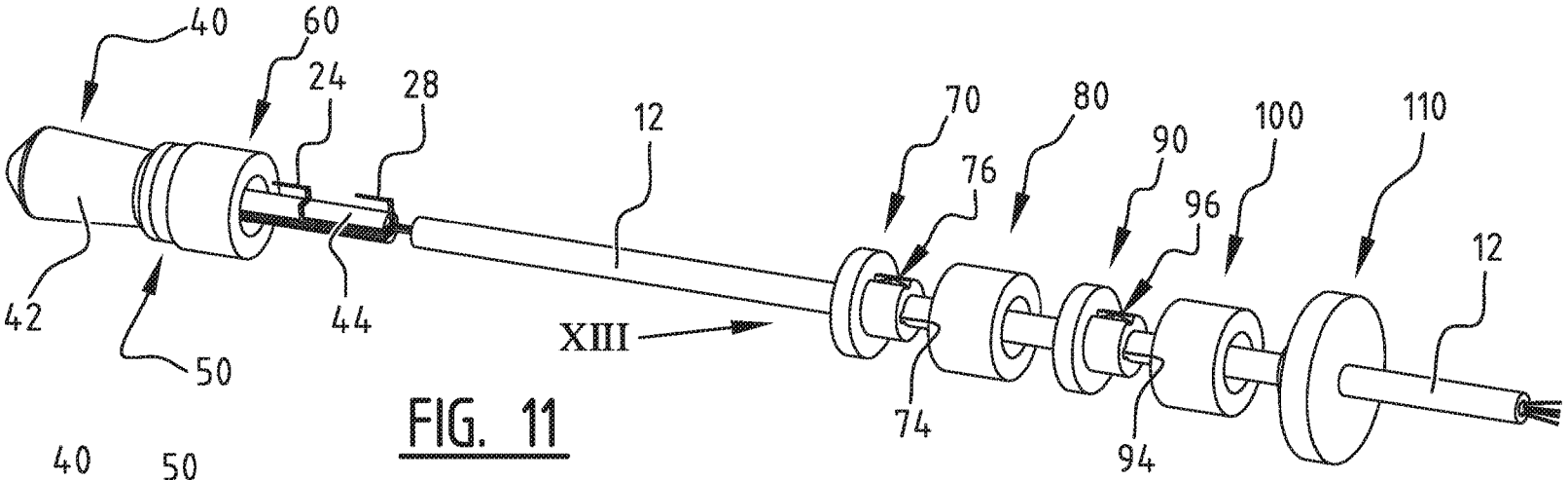
FIGS. 11-14 show the process steps of assembling a conducting member and a further insulation member.
Figure 12:
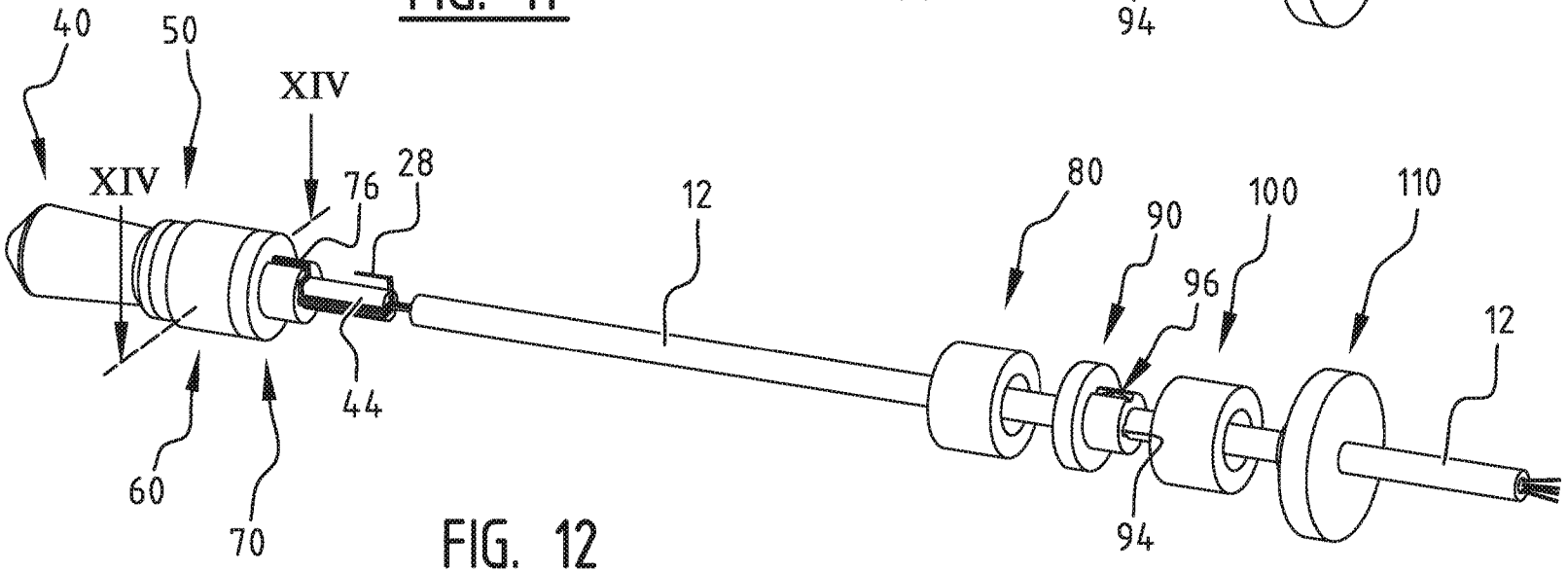

FIG. 8 shows a perspective view of the situation shown in FIG. 10B, wherein the second wire end 20 is arranged in the outer slot 58 that is arranged in the outer wall of the tip member insulator 50.

Figure 14A:
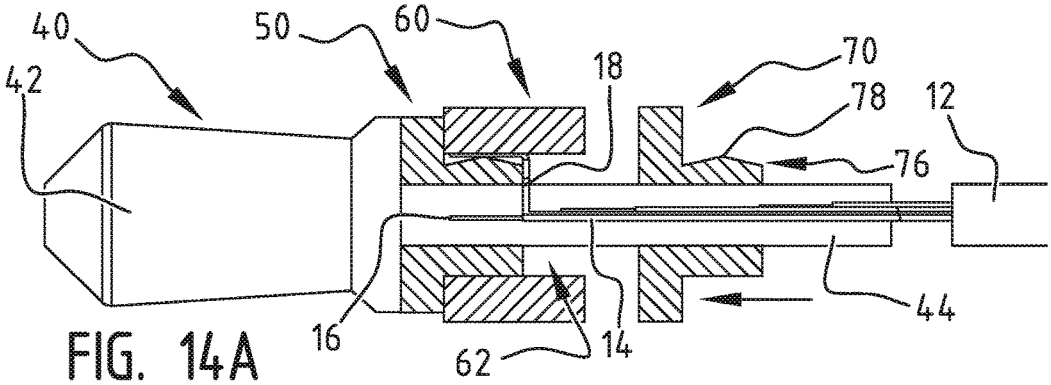

Starting from the situation shown in FIG. 8, a first conducting member 60 is slid around the outer wall of the tip member insulator 50, wherein the wedge-shaped projection 59 arranged in outer slot 58 presses the second wire end 20 of second wire 18 against the inner wall of the first conducting member 60. In this way, the second wire end 20 is electrically and mechanically connected with the first conducting member 60, that forms the second electrically conductive part of the inserting member 36 (FIG. 14A).

After the first connection member 60 has been arranged around the tip member insulator 50, a first insulation member 70 is slid over the shaft 44 and brought into contact with the first conducting member 60. The second wire 18 passes through the open space 62 (FIGS. 14A and 14B).

Figure 13A:
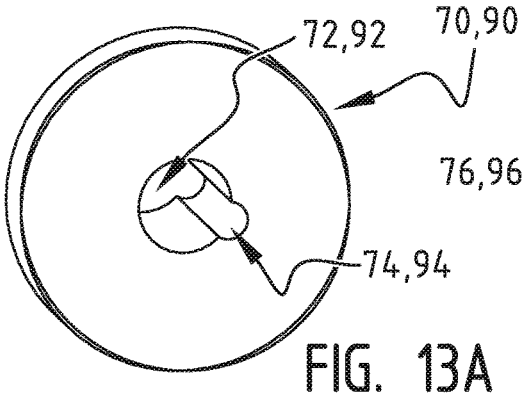
Figure 13B:
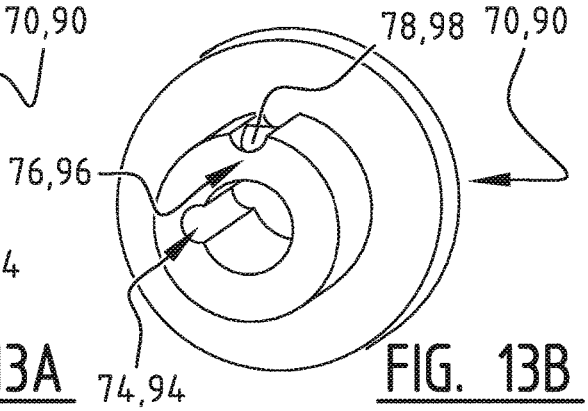
Figure 14B:
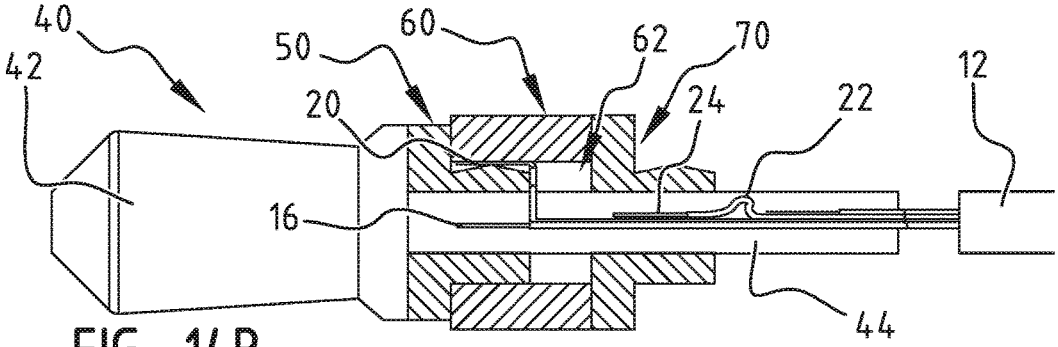
Figure 14C:
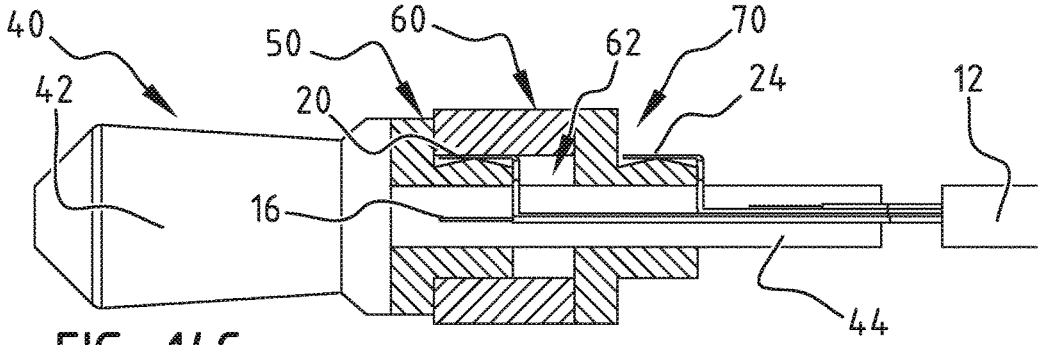

The perspective views of the first insulation member shown in FIG. 13A, 13B shows a first insulation member 70 comprising an inner slot 74 through which the first wire 14 and second wire 18 are guided (FIG. 14B). The third wire end 24 of third wire 22 is placed in the outer slot 76 that again comprises a wedge-shaped projection 78 (FIG. 14C).

Figure 15:
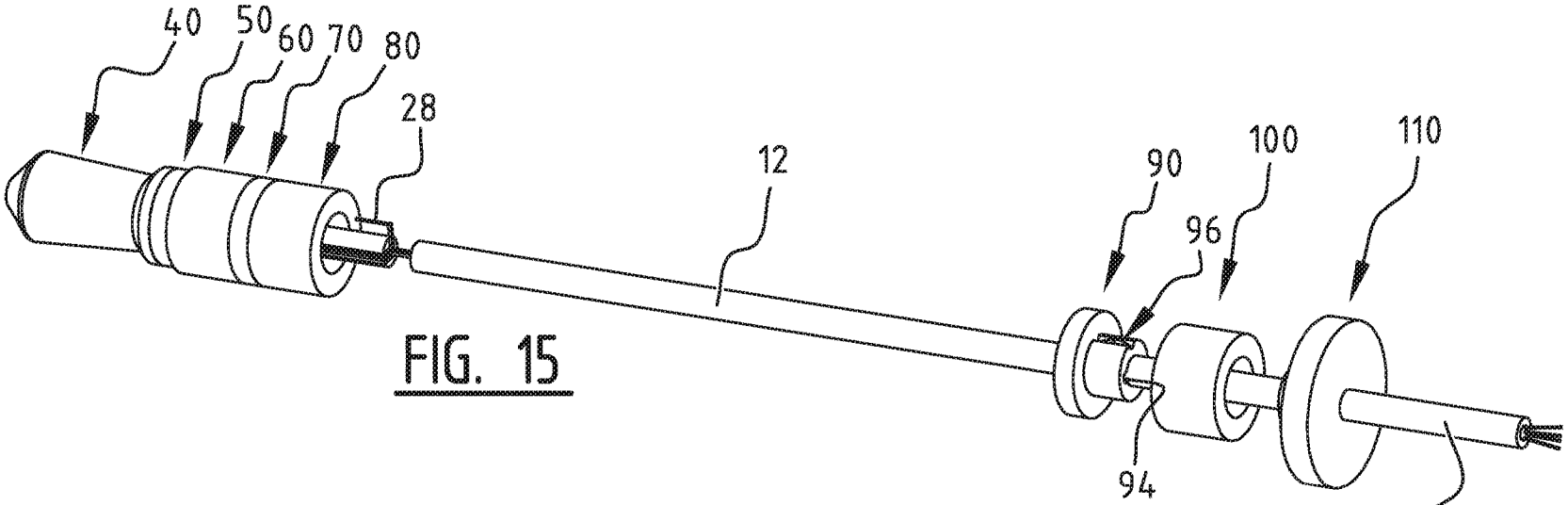
FIGS. 15-17 show the process steps of assembling a further set of a conducting member and accompanying insulation member.
Figure 16:
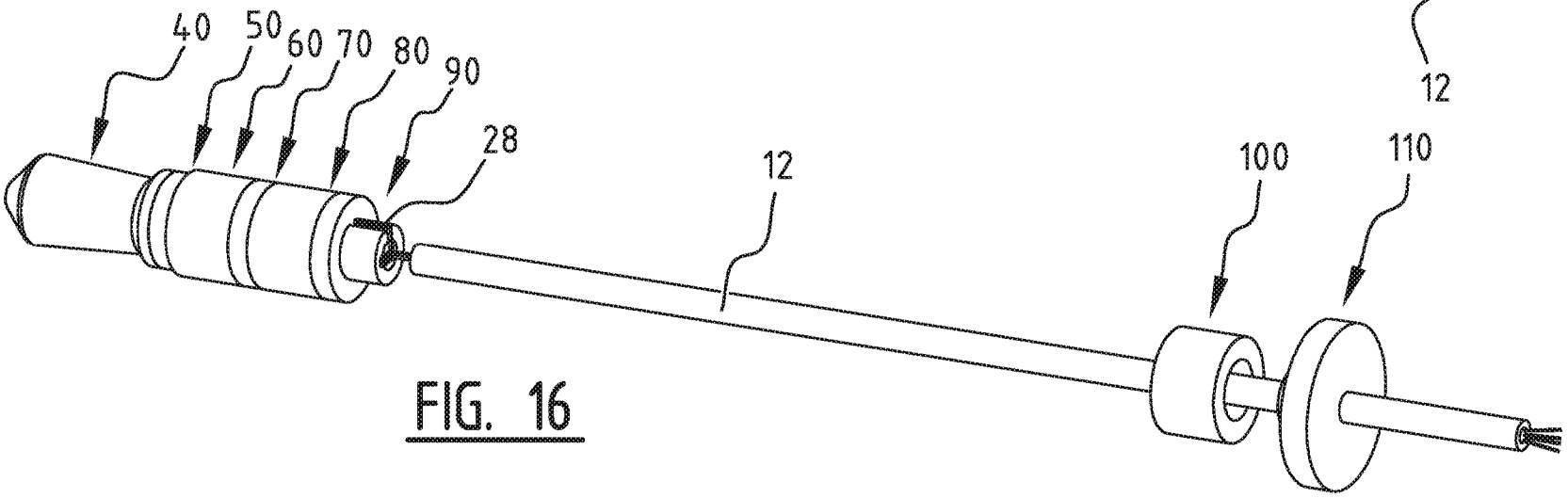
Figure 17:
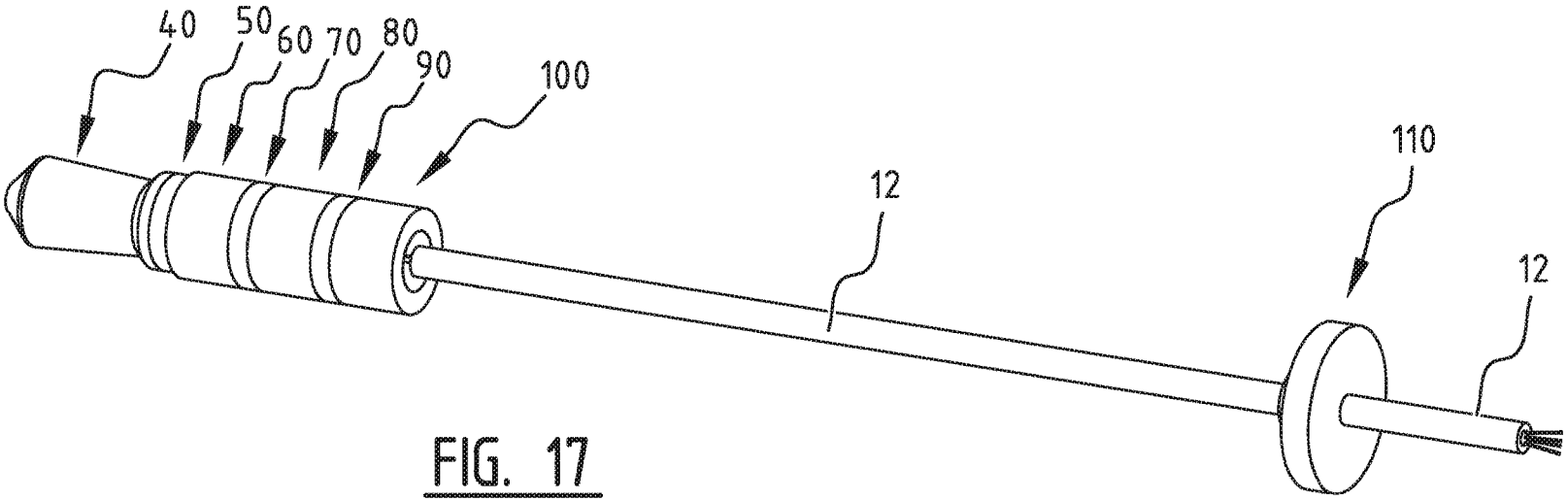
Figure 18:
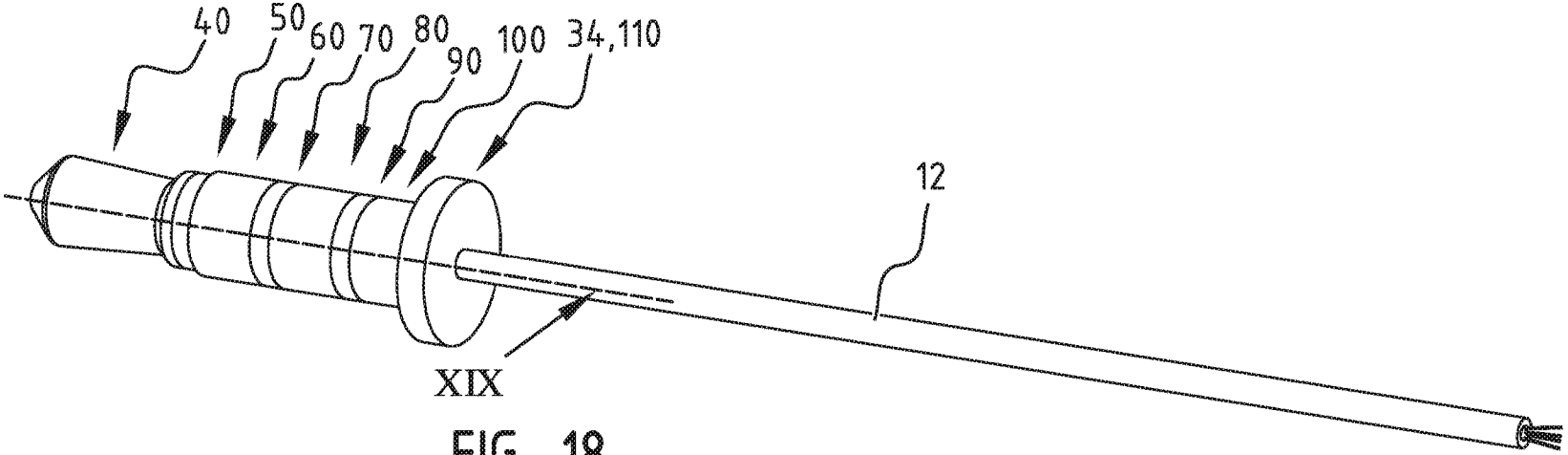
FIG. 18 shows the process step of assembling a closing member.

The steps of FIGS. 11-14C can be repeated until all wire ends 20, 24, 28 are brought into contact with conducting members 60, 80, 100. In FIG. 15, a second conducting member 80 is slid over the first insulation member 70 and brings the third wire end 24 of third wire 22 in contact with the second conducting member 80 that forms a third electrically conductive part of the inserting member (FIG. 15).

After a second insulation member 90 has been slid over the shaft 44, and the fourth wire end 28 of fourth wire 26 has been arranged in an outer slot 96 of the second insulation member 90 (FIG. 16), a third conducting member 100 is slid around the second insulation member 90. The wedge-shaped projection 98 in the outer slot 96 of the second insulation member 90 presses the third wire end 28 against the third conducting member 100 in order to electrically and mechanically connect the wire end 28 with the third conducting member 100. The third conducting member 100 forms the fourth electrically conductive part of the inserting member 36.

It is remarked that the first insulation member 70 and second insulation member 90 are preferably identical parts (both shown in FIGS. 13A and 13B) as this reduces the number of different part required for the connecting device according to the invention.

After the desired number of conducting members 60, 80, 100 and insulation members 50, 70, 90 being arranged around the shaft 44, a closing member 110 is brought into contact with the last conducting member, here conducting member 100, and attached thereto.

The closing member 110 functions for guiding the cable 12 through a through hole thereof, after which the separate wires 14, 18, 22, 26 branch out in different directions inside the space enclosed by the outer surface 38 of the inserting member 36.

Figure 19:
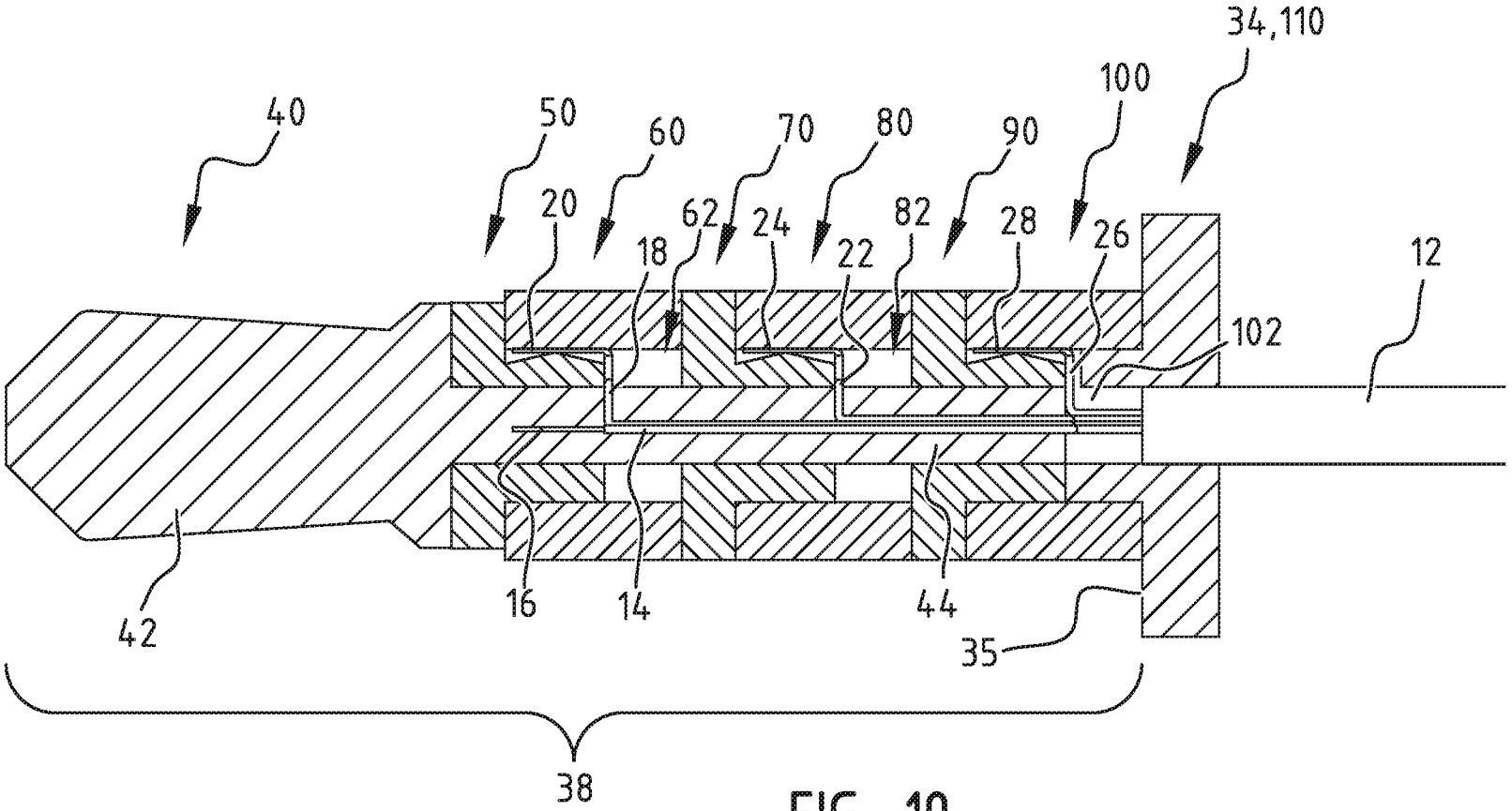
FIG. 19 shows a cross sectional view of an assembled conduction device according to the invention.

The closing member 110 extends in a transverse direction outwards of the outer surface 38 of the inserting member 36, and forms an abutment surface 35 with its surface extending outwards of the outer surface 38 and directed towards the inserting member 36 (FIG. 19).

FIG. 19 shows a cross sectional view of the assembled connecting device according to the present invention, wherein a tip member 40, a tip member insulator 50, a first conducting member 60, a first insulation member 70, a second conducting member 80, a second insulation member 90, a third conducting member 100 and a closing member 110 together form a connecting device. The wires of cable 12 branch out in different directions inside the space enclosed by the outer surface 38 of the inserting members 36 and are guided into slots 54, 58, 78, 98.

The slots are configured for engagement and electrically contacting the wire ends 16, 20, 24, 28 with their respective electrically conducting parts of the inserting member 36, wherein the conductive wire ends of the cable 12 are connected both mechanically and electrically by compression. In the slots, the wire ends are pressed against one of the electrically conductive parts of the inserting member 36. In this way, the wire ends are electrically and mechanically connected to their respective electrically conductive parts.

A further preferred embodiment is shown in FIGS. 20-25. This embodiment differs from the embodiment of FIGS. 1-19, in that the wires 14, 18, 22 and 26 comprise a reverse bend that further increases the strength of the connecting device. It furthermore simplifies the manufacture in that stripping of the insulating material of the wire ends 16, 20, 24 and 28 may be performed automatically, in this way optimizing the connecting device for mass production.

Figure 20:
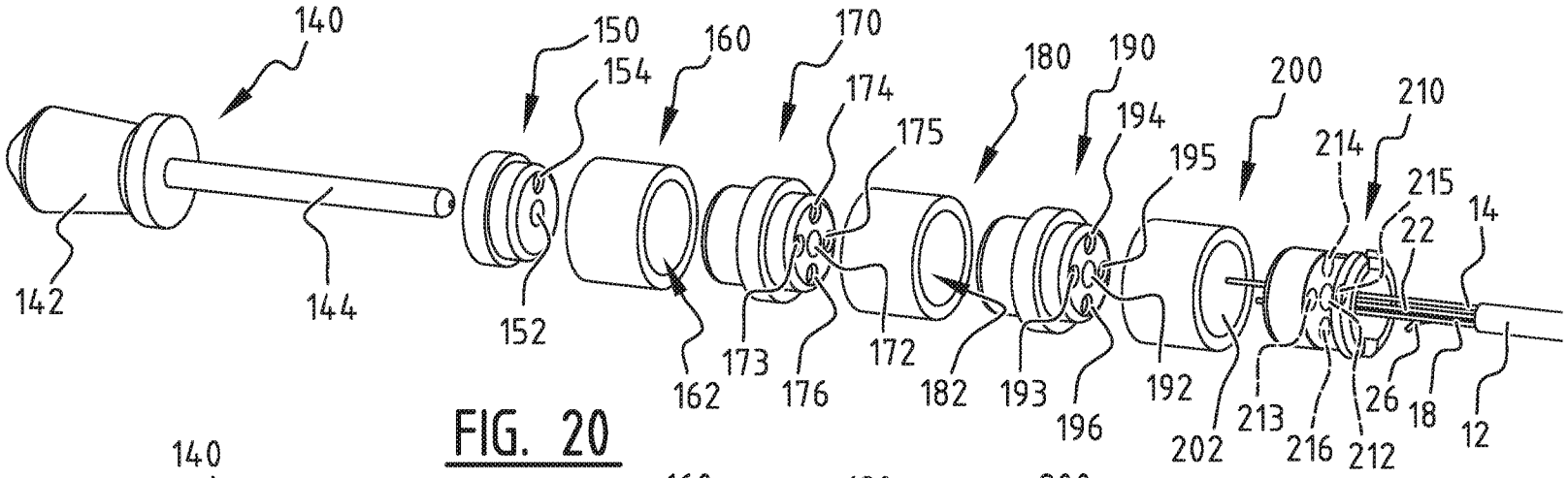
FIG. 20 shows an exploded view of an connecting device according to a further preferred embodiment.

The tip member insulator 150, the first insulation member 170, the second insulation member 190 and the closing member 210 all comprise one or more additional through bores 154, 173-176, 193-196 and 213-216 for passing through the wires 14, 18, 22 and 26 of the connection cable 12 (FIG. 20). The through bores also insulate the wires 14, 18, 22 and 26 from the conducting parts 160, 180, 200, so this second embodiment does not rely on the insulation of the wires.

A further (not shown) synthetical wire may be provided and e.g. pass through the central through bores 152, 172, 192 and 212, where it is clamped with the shaft 144 of the tip member 142 and in this way provides extra tensile strength to the connecting device when a user pulls on the connection cable 12.

Figure 21:
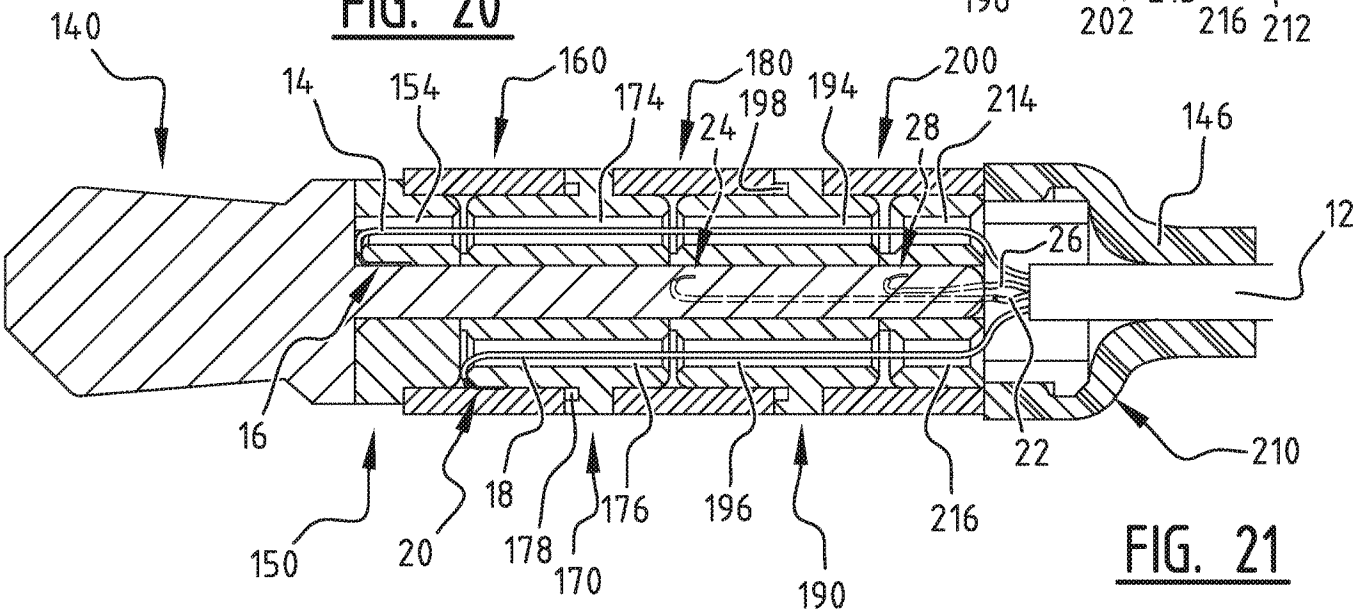
FIG. 21 shows the connecting device of FIG. 20 in an assembled state.

As a consequence of the wires 14, 18, 22 and 26 comprising a reverse bend, the assembly of the connecting device is reversed as well, as will be explained below. This reverse bend is shown for first wire 14 and second wire 18 in FIG. 21, while it is remarked that the third wire 22 and the fourth wire 26 lie outside the section plane shown in FIG. 21. FIG. 21 shows an assembled state of the connecting device, wherein a shrink-sleeve 146 is arranged around the closing member 21 for connecting the connecting device to the connection cable 12.

Figure 22:
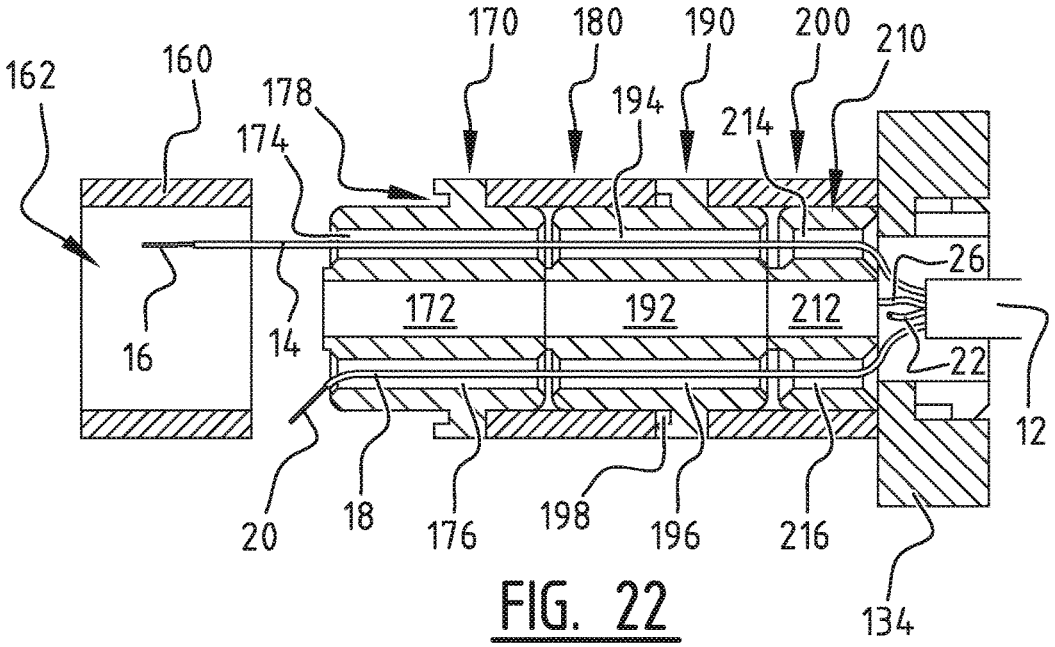
FIGS. 22-25 show successive process steps of assembling the connecting device of FIGS. 20 and 21.
Figure 23:
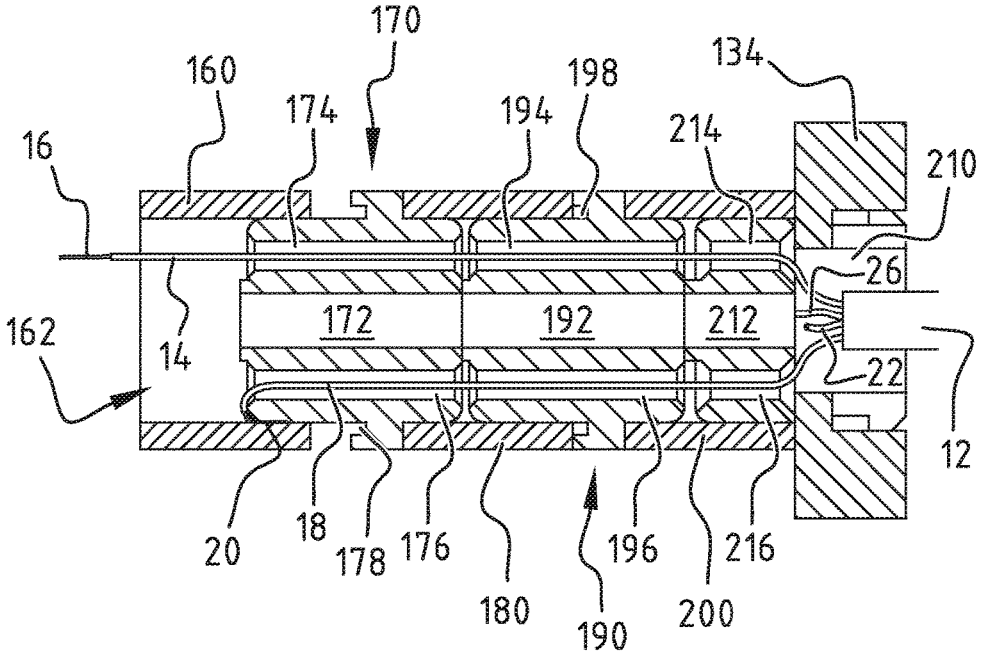
Figure 24:
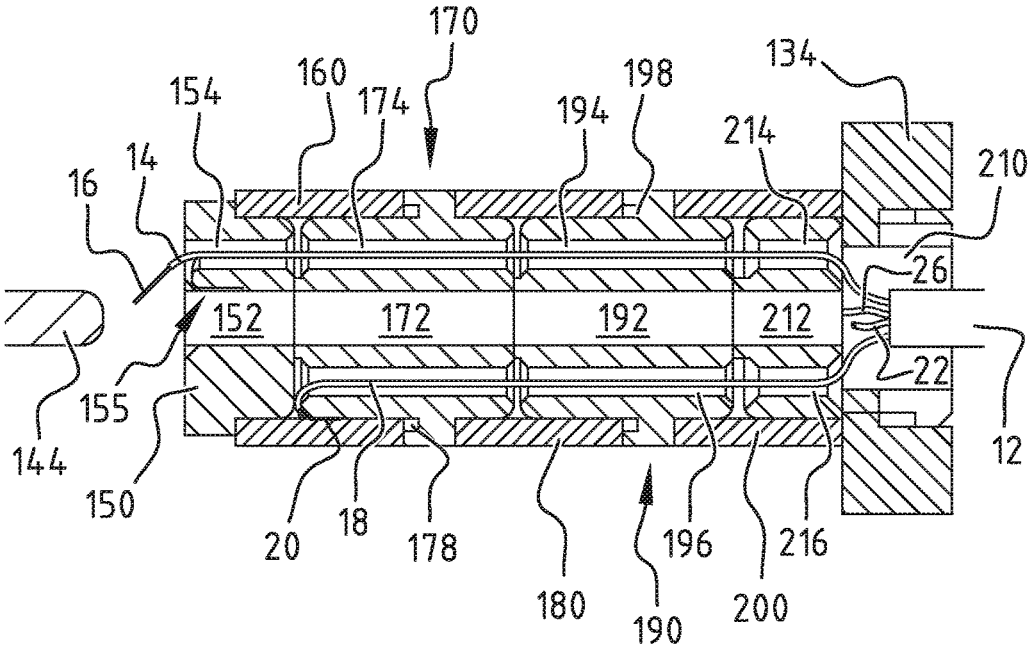

Successive steps of assembling the connecting device of FIGS. 20 and 21 are shown in FIGS. 22-24, wherein an abutment member 134 is temporarily arranged around and engaged with the closing member 210. After assembly, this abutment member 134 is removed.

The fabrication method starts with the step of arranging the closing member 210 on the connection cable 12, wherein said closing member 210 receives an abutment member 134. The connection cable 12 is guided through the closing member 210 in a non-sliding way, and the connection cable 12 is attached to the closing member 210.

The wires 14, 18, 22 and 26 respectively pass through the through bores 214, 216, 213 and 215 of the closing member 210.

Wire end 28 of wire 26 is bend in outside direction, so that the third conducting member 200 will bend the second wire end 28 further backwards when slid over the closing member 210 before clamping it in a reverse direction between the inner wall of the third conducting member 200 and the outer wall of the closing member 210. The clamping results in a mechanical and electrical contact with the third conducting member 200 by means of compression. Please note that the location where wire end 28 of wire 26 and wire end 24 of wire 22 are mechanically and electrically connected by means of compression with their respective conducting parts, i.e. third conducting member 200 and second conducting member 180, lies outside the section plane shown in FIG. 21. The locations are shown using dashed arrows.

In the next step, the third conducting member 200 is slid over the closing member 210 until it abuts the abutment member 134. In this way it is ensured that the third conducting member 200 is perfectly arranged with respect to the closing member 210.

The wires 14, 18 and 22 pass through the central open space 202 of the third conducting member 200 and the wires 14, 18 and 22 are then further guided through a series of aligned through bores.

As shown in the section plane of FIGS. 21-25, the first wire 14 is successively guided through the through bore 214 of the closing member 210, the through bore 194 of the second insulation member 190, the through bore 174 of the first insulation member 170, and the through bore 154 of the tip member insulator 150 (FIG. 21).

In a similar way, the second wire 18 is successively guided through the through bore 216 of the closing member 210, the through bore 196 of the second insulation member 190, and the through bore 176 of the first insulation member 170 (FIG. 21).

In FIG. 22, it is shown that the second wire end 20 of second wire 18 is bend in outside direction, so that the first conducting member 160 will bend the second wire end 20 further backwards before clamping it in a reverse direction between the inner wall of the first conducting member 160 and the outer wall of the first insulation member 170. The clamping results in a mechanical and electrical contact with the first conducting member 160 by means of compression.

Figure 25:
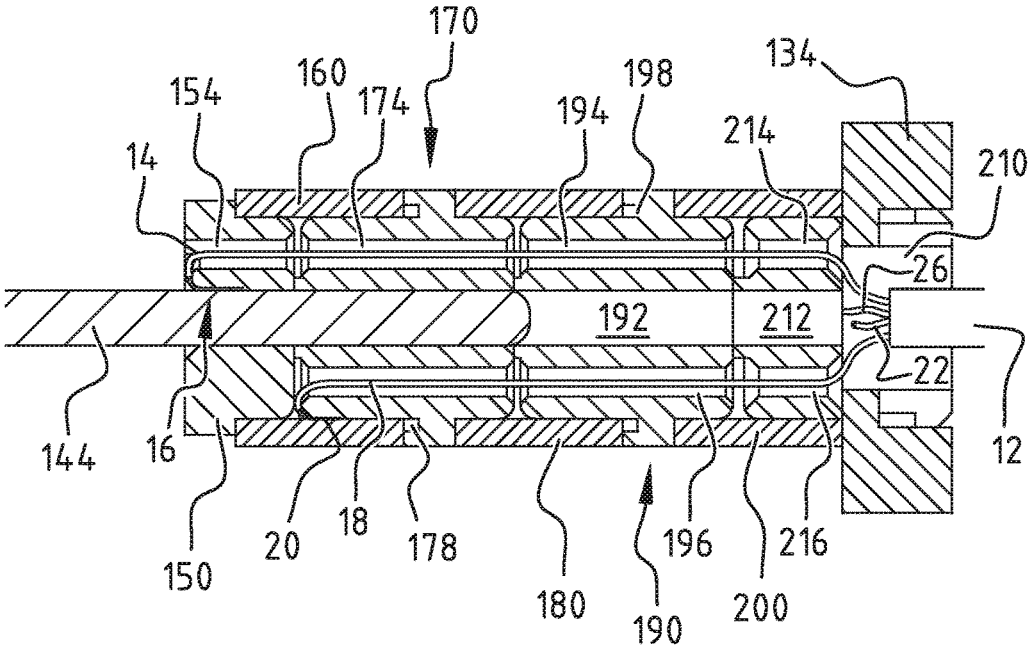

As shown in FIGS. 24 and 25, the first wire end 16 of first wire 14 is bend inwards (FIG. 24) so that the shaft 144 of the tip member 140 forces the first wire end 16 in the through bore 152 of the tip member insulator 150 (FIG. 25), where it is in mechanical and electrical contact with the tip member 140 by means of compression.

A surface or an inner slot 153 is arranged in the wall of the through bore 152, and is configured for receiving the wire end 16 of the first electrically conductive wire 14 of the connection cable in order to electrically and mechanically connect the shaft 44 and the wire end 16 by means of compression.

After the tip member 140 being inserted in the through bores 152, 172, 192 and 212, the abutment member 134 is removed from the closing member 210, and a shrink-sleeve or other suitable connection may be arranged around the closing member 210 (FIG. 21) in order to connect the connecting device with the connection cable 12.

Figure 26:
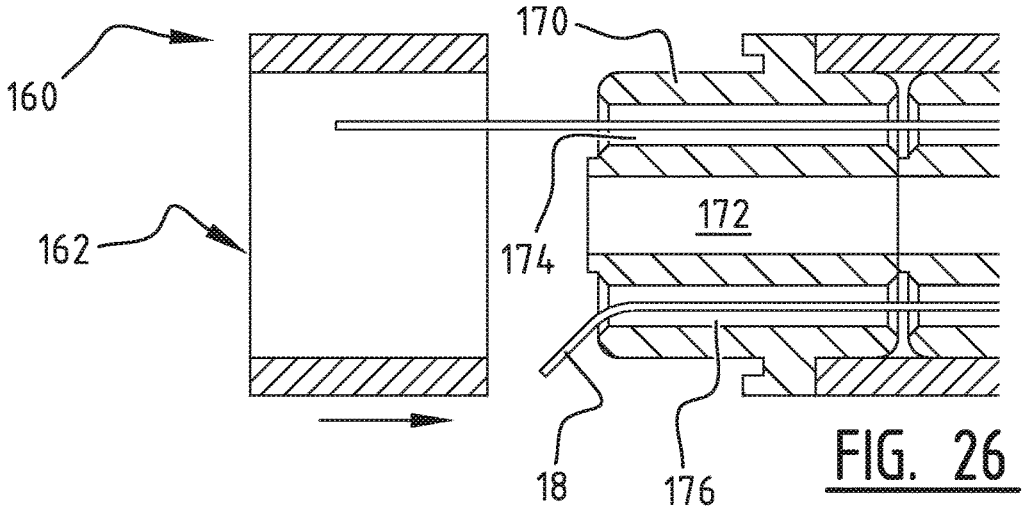
FIGS. 26-28 show successive process steps of automatic stripping of the wires during assembly of the connecting device.
Figure 27:
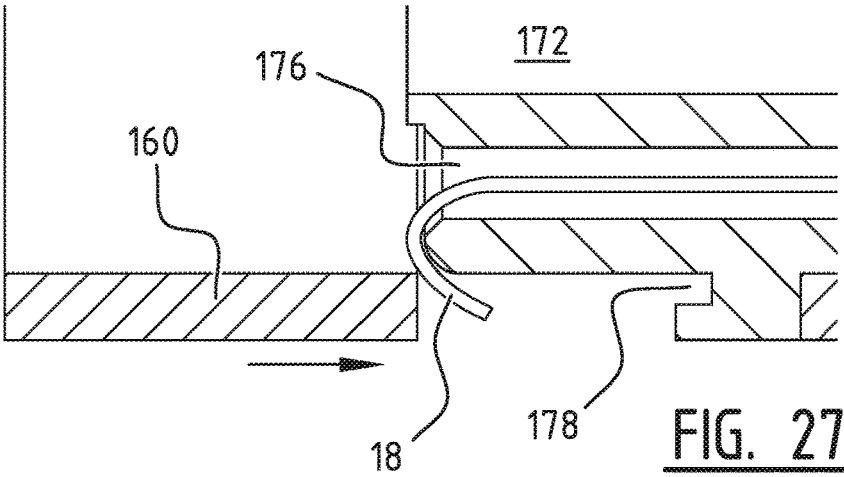
Figure 28:
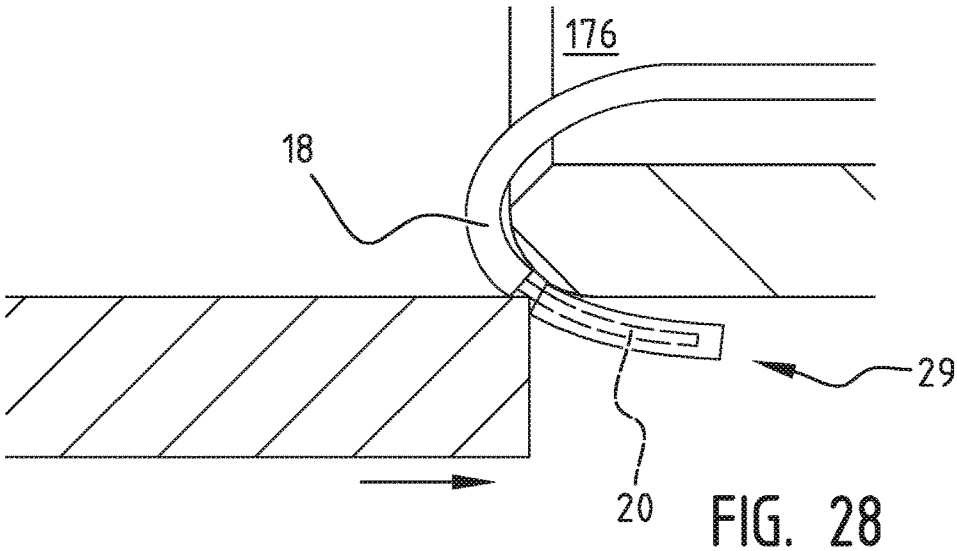

Although the wire ends 16, 20 of the first wire 14 and second wire 18 are stripped, i.e. the insulation material being removed before assembly, this is not necessary. FIGS. 26-28 show successive process steps of automatic stripping of the wires during assembly of the connecting device, wherein insulation material is automatically stripped off of the wire. A circumferential groove 178 is provided in the first insulation member 170 for receiving the stripped off material (FIG. 27). The second insulation member 190 comprises a similar circumferential groove 198.

Although they show preferred embodiments of the invention, the above described embodiments are intended only to illustrate the invention and not to limit in any way the scope of the invention. It is particularly noted that the invention is not limited to audio jacks, and that the cross section of the connecting device might also be rotation asymmetric and/or polygonal instead of the circular cross section shown in the figures.

The skilled person can combine technical measures of the different embodiments. For example, the embodiment of FIGS. 1-19 might also comprise a further synthetical wire in order to further increase the tensile strength it can withstand without failure.

The scope of the invention is therefore defined solely by the following claims.

What is claimed is:

1. Connecting device for insertion into a connection jack, said connecting device comprising:

a substantially elongated inserting member that is extending in a longitudinal direction and that is insertable into the connection jack of an electronic device, said inserting member further comprising a transverse direction extending transverse thereto, said inserting member further comprising an outer surface with at least two electrically conductive parts with insulating material arranged there between;

wherein the inserting member is configured to, by means of compression, clamping at least two wire ends between an inner wall of the least one of the at least two electrically conductive parts and an outer wall of an insulation member, mechanically and electrically connect the at least two electrically conductive parts with the at least two wire ends of a connection cable within a space enclosed by the outer surface of the inserting member, wherein the at least two wire ends of the connection cable extend directly from the connection cable into the inserting member without any electrical connection between exiting the connection cable and entering the inserting member, and all of the electrical connections between wires extending from the connection cable and the at least two electrically conductive parts take place within the inserting member; and the inserting member is configured such that wires of the connection cable branch out in different directions inside the space enclosed by the outer surface of the inserting member.

2. Connecting device according to claim 1, further comprising an abutment member arranged in line with the inserting member and that does extend in the transverse direction outward of the outer surface of the inserting member, and wherein an extending surface that is directed towards the inserting member forms an abutment surface.

3. Connecting device according to claim 2, wherein the abutment member comprises a guide slot for guiding a connection cable to the space enclosed by the outer surface of the inserting member.

4. Connecting device according to claim 1, wherein the connecting device is configured wherein when the connecting device is connected to the connection cable the electrically conductive wires of the connection cable diverge away from each other within the space enclosed by the outer surface of the inserting member.

5. Connecting device according to claim 1, wherein the connecting device is configured to have the electrically conductive wires electrically and mechanically connectable to the at least two electrically conductive parts by means of a compression connection within the space enclosed by the outer surface of the inserting member.

6. Connecting device according to claim 1, wherein the inserting member comprises:

an electrically conductive tip member comprising a tip and a shaft, wherein the tip member forms a first electrically conductive part of the inserting member;

a first conducting member that forms a second electrically conductive part of the inserting member; and a tip member insulator that is arranged between the tip member and the first conducting member and electrically isolates the tip member and first conducting member from each other.

7. Connecting device according to claim 6, wherein the tip member insulator comprises:

a first through bore that allows the tip member insulator to be substantially close-fittingly arrangeable around the shaft of the tip member; and a surface or an inner slot that is arranged in a wall of the through bore and that is configured for receiving a wire end of a first electrically conductive wire of the connection cable, and that is further configured for electrically and mechanically connecting the shaft and the wire end by means of compression.

8. Connecting device according to claim 5, further comprising a second through bore configured for passing there through at least the electrically conductive wire of which the wire end is reversed and arranged on the surface or in said inner slot.

9. Connecting device according to claim 5, wherein a first conducting member is arrangeable substantially close-fittingly around a part of the outer wall of the tip member insulator, wherein the first conducting member forms a second electrically conductive part of the outer surface of the inserting member.

10. Connecting device according to claim 6, comprising one or more further insulation members that are close-fittingly arranged, said insulation members comprising:

a through bore that allows the insulation member to be arranged substantially close-fittingly around the shaft of the tip member;

a through bore for guiding there through one or more electrically conductive wires; and an outer wall that is configured for receiving a wire end of an electrically conductive wire of a connection cable, said outer wall being configured to allow the wire end of the electrically conductive wire to be pressed against the conducting member in order to form an electrical and mechanical connection between the wire end and the conducting member.

11. Connecting device according to claim 1, wherein a circumferential groove is provided for receiving scraped off insulation material.

12. Connecting device according to claim 1, wherein outer surfaces of a tip member insulator, the at least two electrically conductive parts and insulating material together form a substantially flush outer surface of the inserting member.

13. Connecting device according to claim 1, wherein a tip member insulator, the at least two electrically conductive parts and the insulating material are ring shaped and together form a substantially flush rotation symmetric outer surface of the inserting member.

14. Connecting device according to claim 1, wherein the connecting device is an audio jack plug, and wherein outer dimensions of the outer surface of the inserting member are substantially identical to outer dimensions of a conventional audio jack plug.

15. An assembly of a connection cable and a connecting device according to claim 1, wherein electrically conductive wires of the connection cable branch out within the space enclosed by the outer surface of the inserting member, and are each electrically and mechanically connected with an electrically conductive part of the inserting member of the connecting device in this enclosed space.

16. A method of connecting a connecting device to a connection cable, said method comprising the steps of:

providing a connecting device in the form of an audio jack plug, said connecting device including a substantially elongated inserting member that is extending in a longitudinal direction and that is insertable into a connection jack of an electronic device, said inserting member further comprising a transverse direction extending transverse thereto, said inserting member further comprising an outer surface with at least two electrically conductive parts with insulating material arranged there between, and wherein the inserting member is configured to mechanically and electrically connect the at least two electrically conductive parts with at least two wire ends of a connection cable within a space enclosed by the outer surface;

arranging a closing member, at least one conducting member and a tip member insulator on the connection cable;

placing wire end of a first wire in contact with a tip member, wherein the tip member comprises a tip and a shaft;

sliding the tip member insulator over the shaft towards and against the tip of the tip member, wherein the wire end is arranged in an inner slot and is electrically and mechanically connected in said slot to the tip member by means of compression;

arranging a wire end of a second electrically conducting wire in an outer slot that is arranged in an outer wall of the tip member insulator;

sliding a first conducting member over the outer wall of the tip member insulator, wherein the wire end is electrically and mechanically connected to the first conducting member by means of compression; and connecting a closing member with a conducting member, wherein said closing member functions as an abutment member and wherein the connection cable is guided through the closing member in a non-sliding way and wherein the connection cable is attached to the closing member.

17. The method according to claim 16, wherein one or more further sets of an insulation member and accompanying conducting member are arranged between the closing member and the tip member in order to electrically and mechanically connect further wire end to an accompanying conducting member by means of compression.

18. The method according to claim 17, wherein the one or more further sets of insulation members and accompanying conducting members are threaded on the connection cable before the tip member insulator is threaded on the connection cable.

19. A method of connecting a connecting device according to claim 1 to a connection cable, said method comprising the steps of:

arranging a closing member with an abutment member on a connection cable;

guiding wires of connection cable through one or more through bores of the closing member;

bending wire end of wire so that it is bend away from the longitudinal direction of the wires through the one or more through bores;

arranging a conducting member over the closing member until it abuts the abutment member against the closing member, wherein the bend wire end is pressed so that it bends further in a reverse bend, wherein the wire end comes in an electrical and mechanical connection by means of compression with said conducting member;

arranging an insulation member in the conducting member and guiding the one or more wires through one or more through bores thereof;

bending a wire end of at least one of the wires so that it is bend away from the longitudinal direction of the wires through the one or more through bores; and arranging a further conducting member against the previous insulation member, wherein the bend wire end is pressed so that it bends further in a reverse bend, wherein the wire end comes in an electrical and mechanical connection by means of compression with said further conducting member.

20. The method according to claim 19, further comprising the step of arranging one or more further sets of an insulation member and mating conducting member.

21. The method according to claim 19, further comprising the step of concluding the assembly with a conducting member that is a tip member.

22. The method according to claim 19, wherein the connection cable is guided through the closing member in a non-sliding way, and the connection cable is attached to the closing member.

23. The method according to claim 19, wherein first the closing member is arranged on the connection cable, followed by the abutment member being arranged on the closing member.

24. The method according to claim 19, wherein the abutment member is removed from the closing member after the final conduction member has been arranged.

25. A connecting device for insertion into a connection jack, said connecting device comprising:

a substantially elongated inserting member that is extending in a longitudinal direction and that is insertable into the connection jack of an electronic device, said inserting member further comprising a transverse direction extending transverse thereto, said inserting member further comprising an outer surface with at least two electrically conductive parts with insulating material arranged there between;

wherein the inserting member, by means of compression, clamping at least two wire ends between an inner wall of the least one of the at least two electrically conductive parts and an outer wall of an insulation member, mechanically and electrically connects the at least two electrically conductive parts with the at least two wire ends of a connection cable within a space enclosed by the outer surface of the inserting member, wherein the at least two wire ends of the connection cable extend directly from the connection cable into the inserting member without any electrical connection between exiting the connection cable and entering the inserting member, and all of the electrical connections between wires extending from the connection cable and the at least two electrically conductive parts take place within the inserting member; and the wires of the connection cable branch out in different directions inside the space enclosed by the outer surface of the inserting member.

26. The connecting device of claim 25, wherein all of the electrical connections between the connection cable and the at least two electrically conductive parts take place within the inserting member and forward of an abutment member arranged in line with the inserting member that extends transversely and includes an abutment surface that extends towards the inserting member.

27. The connecting device of claim 1, wherein the inserting member is configured such that all of the electrical connections between the connection cable and the at least two electrically conductive parts take place within the inserting member and forward of an abutment member arranged in line with the inserting member that extends transversely and includes an abutment surface that extends towards the inserting member.

* * * * *